US006699080B1

(12) United States Patent
Costa

(10) Patent No.: US 6,699,080 B1
(45) Date of Patent: Mar. 2, 2004

(54) SNAP TERMINAL WITH ANNULAR STANDOFF

(76) Inventor: Larry J. Costa, 55613 Currant Rd., Mishawaka, IN (US) 46545

( * ) Notice: Subject to any disclaimer, the term of this patent is extended or adjusted under 35 U.S.C. 154(b) by 0 days.

(21) Appl. No.: 10/340,906

(22) Filed: Jan. 10, 2003

(51) Int. Cl.[7] ..... H01R 4/02
(52) U.S. Cl. ..... 439/876
(58) Field of Search ..... 439/876, 83; 29/843

(56) References Cited

U.S. PATENT DOCUMENTS 4,246,467 A 1/1981 Boaz ..... 219/522
6,039,616 A * 3/2000 Pereira et al. ..... 439/874
6,249,966 B1 * 6/2001 Pereira et al. ..... 29/882
6,599,156 B2 * 7/2003 Pereira et al. ..... 439/874

* cited by examiner

*Primary Examiner*—Tulsidas Patel
*Assistant Examiner*—Phuong K Dinh
(74) *Attorney, Agent, or Firm*—Thomte, Mazour & Niebergall; Shane M. Niebergall

(57) ABSTRACT

The snap terminal of the present invention is provided with a top wall, a vertical wall, an annular flange, and an annular setoff extending therefrom. The setoff is positioned concentric to the open portion of the terminal. In use, the setoff provides a space between the flange and a component for receiving a minimum volume of solderable material. The setoff further prevents excess solderable material from flowing into the open portion of the terminal when the terminal is soldered to a component. The terminal may be formed in a one-piece unitary construction.

8 Claims, 1 Drawing Sheet

SNAP TERMINAL WITH ANNULAR STANDOFF

BACKGROUND OF THE INVENTION

The present invention relates to a snap terminal, and more particularly to a snap terminal having a generally annular standoff extending downwardly from its base to form an improved connection between the terminal and a component.

DESCRIPTION OF THE PRIOR ART

Electrical terminals must be connected to certain articles of manufacture to allow for the flow of electricity from one medium to a different medium. This is particularly true in instances where the conductive elements are embedded in a non-conductive material, such as glass or dielectric substrate. In, for instance, automotive glass panels having electrical wiring embedded therein for the purpose of defogging the window, electrical terminals must be attached to the glass panels to provide a point of connection for electrical current input and output.

Snap terminals are sometimes employed in this fashion. Snap terminals are generally two-piece terminals which are arranged in a mating configuration. Each of the terminals is electrically and mechanically connected to a component and the snap terminal components are then mated to form a releasable electrical and/or mechanical connection between the components. Snap terminals are commonly provided on 9-volt batteries.

The second type of snap terminal is formed by "crimping." A snap terminal formed by the "crimping" method joins two pieces: a hat-shaped base and a circular solder disc. The base used has a circular top wall, a vertical wall extending downwardly therefrom, and an annular flange. The solder disc which is joined to the base has, however, a diameter that is larger than that of the annular flange. The solder disc is placed substantially concentric to the annular flange, and the solder at the periphery of the disc is wrapped around the annular flange and crimped into place. In use, sufficient heat is applied to the terminal to melt the solder and adhere the terminal to a component.

The use of standoffs for soldering planar terminals is taught in U.S. Pat. No. 4,246,467 for extending a substantial portion of the terminal base in a spaced but substantially parallel plane with respect to a component. The result is the creation of an offset spacing for the solder to fill. The spacing defines a minimum volume between the terminal and the component in an attempt to create a uniform solder connection. U.S. Pat. Nos. 6,039,616 and 6,249,966 disclose the use of such standoffs with circular electrical terminals. However, the conditions present in many soldering applications render the creation of a uniform solder fillet difficult, if not impossible, regardless of the use of standoffs as taught by the prior art.

Environmental considerations are requiring the use of lead-free solder alloys. The use of lead-free solder increase the solder's liquidus temperature 31%, with up to 94% less modules of elasticity for the new solder alloy. This makes having the most uniform solder fillet possible essential. Almost all of the automotive glass manufactured today is curved for design and aerodynamic considerations. This makes it difficult to solder because the terminal location is usually on an angle, and the effect of gravity on the molten solder can cause it to collect on the downward slope of the surface inside the hollow snap, where it forms an undetected irregular solder fillet that mechanically weakens the soldered connection.

Accordingly, what is needed is a snap terminal having a standoff that provides a space between the terminal and the component to define a minimum volume in which a solderable material can flow and further serves as a barrier to prevent additional solderable material from flowing into the hollow portion of the snap and forming an irregular solder fillet.

SUMMARY OF THE INVENTION

A male snap terminal is described which includes a base having a top wall, a vertical wall, an annular flange, and an annular standoff, which extends downwardly therefrom. The standoff defines an open space between the annular flange and a component when the terminal is positioned closely adjacent the component. The open space provides a minimum volume for receiving solderable material when the terminal is soldered to the component. The standoff is positioned concentric to the open portion of the snap terminal so that the standoff will serve as a barrier to substantially prevent excess solderable material from flowing into the open portion of the terminal and creating an irregular solder fillet therein.

It is therefore a principal object of the invention to provide a snap terminal having a generally annular standoff that provides a minimum volume for receiving solderable material when the terminal is positioned closely adjacent a component to which it is to be soldered.

Yet another object of the invention is to provide a snap terminal having a standoff that prevents excess solderable material from flowing into the open portion of the terminal when the terminal is soldered to a component.

Still another object of the present invention is to provide a snap terminal that is formed of one-piece unitary construction with an annular standoff, which prevents excess solderable material from flowing into the open portion of the terminal when the terminal is soldered to a component.

These and other objects will be apparent to those skilled in the art.

DESCRIPTION OF THE PREFERRED EMBODIMENT

Figure 1:
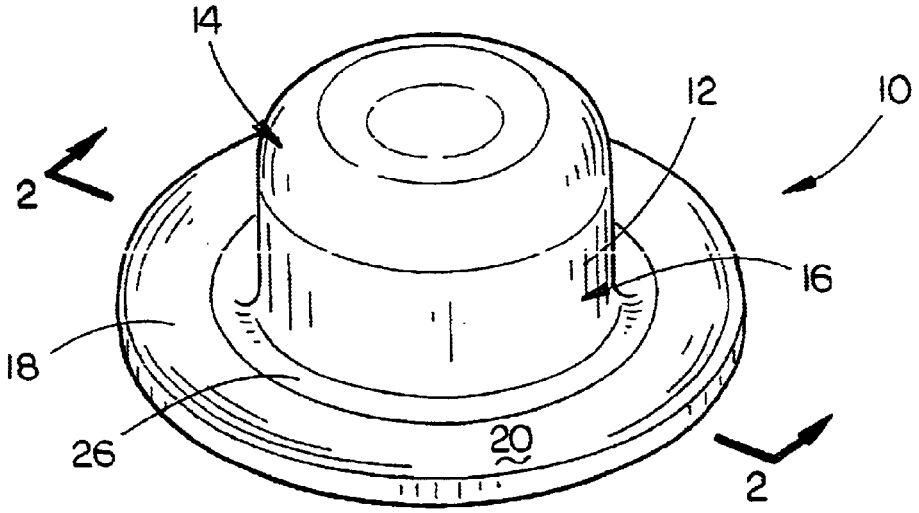
FIG. 1 is a perspective view of the snap terminal of the present invention.
Figure 2:
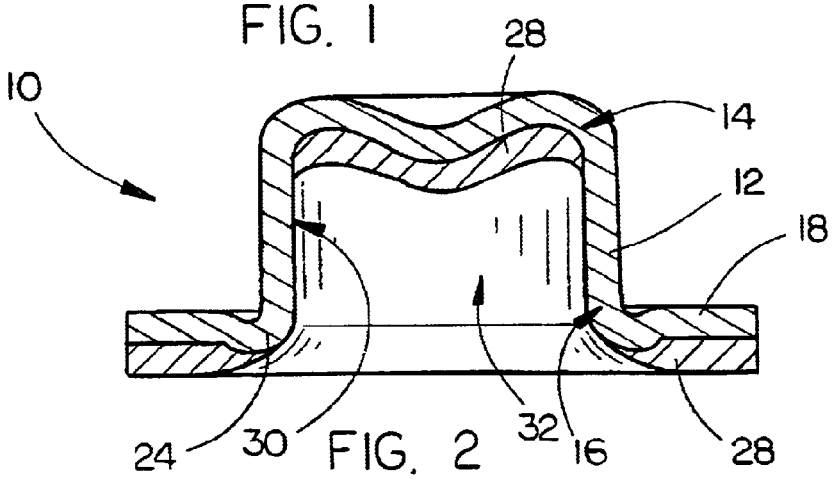
FIG. 2 is a cross-sectional view of the snap terminal of FIG. 1.
Figure 3:
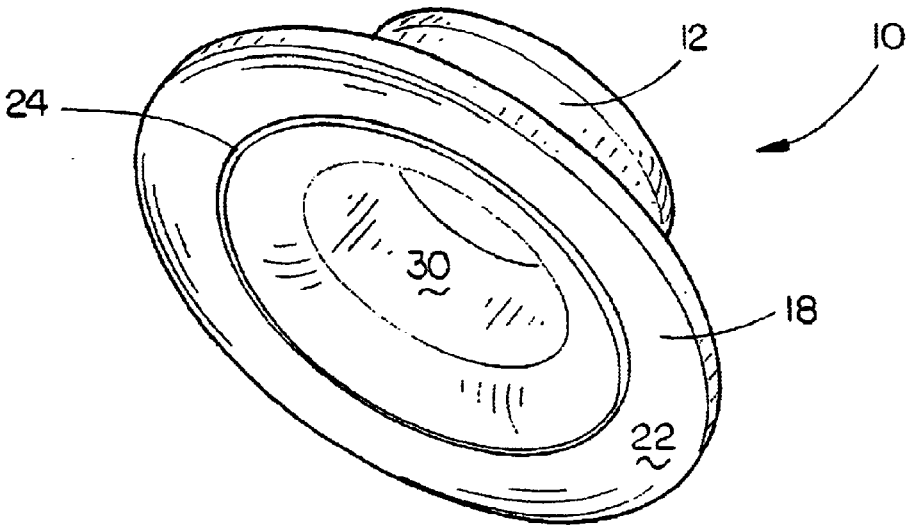
FIG. 3 is a perspective view of the lower surface of the snap terminal of FIG. 1.

The numeral 10 refers generally to the snap electrical terminal of this invention.

Terminal 10 generally includes a body member 12 having an upper end portion 14 and a lower end portion 16. The body member 12 is preferably hat-shaped, having a lgenerally circular, horizontal top wall. However, it is contemplated that the body member 12 can be formed into nearly any shape, which may be required by any particular application and use. An annular wall extends between the upper end portion 14 and the lower end portion 16 of the body member 12. The lower end portion 16 of the body member 12 has extending outwardly therefrom an annular, generally horizontal flange 18, having an upper surface 20 and a lower surface 22.

A generally annular standoff 24 extends downwardly from the lower surface 22 of the flange 18. It is contemplated that the standoff 24 may be formed in nearly any shape, such as circular, elliptical, octagonal, square, triangular, etc. It is further contemplated that the general shape of the standoff 24 need not be completely enclosed. It is contemplated that one or more "breaks" in the shape of the standoff could be provided such that the objects of the present invention could still be fulfilled.

The standoff 24 can be formed in several different ways. Where the terminal 10 is to be formed from a single sheet of conductive material, the standoff 24 can be "pressed" into the terminal 10, intermediate the body member 12 and the flange 18. It is contemplated that the standoff 24 could also be formed in a terminal 10 that had been previously formed into a snap terminal by any method known in the art. When formed in this manner, a generally annular recess 26 will be formed in the upper surface 20 of the flange 18. However, where it is not desired to form the standoff 24 in this manner, it is contemplated that the standoff 24 could be formed as a separate article of manufacture and secured to the lower surface 22 of the flange 18 using one of several known methods in the art.

Regardless of the method of forming, it is preferred that the standoff 24 extend downwardly from the flange 18 by at least a distance D. The distance D is chosen by the user to provide a space between the lower surface 22 of the flange 18 and the component to which the terminal 10 will be secured. The space formed by the standoff 24 will have a minimum volume in which a solderable material or adhesive will fill in order to make the connection between the terminal 10 and the component. Accordingly, the volume of the space can be dictated by the user by increasing or decreasing the distance D in which the standoff 24 extends beneath the flange 18.

The terminal 10 may be manufactured to include a solderable material 28 on the lower surface 22 of the flange 18 and on the inner surface 30 of the body member 12. It is also contemplated that a conductive or non-conductive adhesive material known in the art may be used in place of the solderable material 28 to create a mechanical or electrical and mechanical connection between the terminal 10 and the component.

It is preferred that the standoff 24 be positioned concentric to the open portion of the terminal 10. In this position, the standoff 24, when positioned closely adjacent the component, will serve as a barrier to substantially prevent excess solderable material 28 or other adhesive material from flowing into the open cavity 32 of the body member 12. The barrier provided by the standoff 24 will thus substantially prevent the pooling of the solderable material 28 from collecting on the downward slope of the surface 30 when the terminal 10 is secured to a component positioned at an angle with respect to the horizontal. Accordingly, where "breaks" are provided in the shape of the standoff 24, it is preferred that the breaks have a size insufficient for the solderable material 28 to flow therethrough.

In the drawings and in the specification, there have been set forth preferred embodiments of the invention; and although specific items are employed, these are used in a generic and descriptive sense only and not for purposes of limitation. Changes in the form and proportion of parts, as well as substitute of equivalents, are contemplated as circumstances may suggest or render expedient without departing from the spirit or scope of the invention as further defined in the following claims.

Thus it can be seen that the invention accomplishes at least all of its stated objectives.

I claim:

1. A terminal for connection to a component, comprising:

a body member having an upper end portion, an open lower end portion and an inner cavity;

a flange, having upper and lower surfaces, extending outwardly from the lower end portion of said body member; and a generally annular standoff operatively connected to the lower surface of said flange;

said standoff being positioned generally concentric to the open lower end portion of said body member.

2. The terminal of claim 1 further comprising a layer of solderable material disposed on the lower surface of said flange.

3. The terminal of claim 1 further comprising a layer of solderable material disposed within the inner cavity of said body member.

4. The terminal of claim 2 further comprising a layer of solderable material disposed within the inner cavity of said body member.

5. The terminal of claim 1 further comprising a layer of adhesive disposed on the lower surface of said flange.

6. The terminal of claim 1 wherein said standoff is shaped to substantially prevent solderable material from flowing into the inner cavity of said body member from between the lower surface of said flange and the component when the terminal is connected to the component with a solderable material.

7. The terminal of claim 1 wherein said body member, flange and standoff are of one-piece unitary construction.

8. The terminal of claim 1 wherein said standoff is sized to define a space having a minimum volume between the lower surface of said flange and the component for the receipt of connective material when the terminal is positioned closely adjacent the component.

* * * * *